US005816454A

United States Patent [19]

Odessa

[11] Patent Number: 5,816,454

[45] Date of Patent: Oct. 6, 1998

[54] PUMP UNIT

[75] Inventor: Ronald M. Odessa, Batavia, N.Y.

[73] Assignee: Chapin Manufacturing, Inc., Batavia, N.Y.

[21] Appl. No.: 760,428

[22] Filed: Dec. 4, 1996

[51] Int. Cl.[6] ..... B67D 5/40

[52] U.S. Cl. ..... 222/383.1; 285/35

[58] Field of Search ..... 222/382, 383.1; 285/33, 34, 35, 319, 373

[56] References Cited

U.S. PATENT DOCUMENTS

| | | | |
|---|---|---|---|
| 1,059,373 | 4/1913 | King . | |
| 1,439,295 | 12/1922 | Craig . | |
| 1,986,756 | 1/1935 | Brundrett | 299/97 |
| 2,281,142 | 4/1942 | Davis | 299/97 |
| 2,348,190 | 5/1944 | Bullock | 103/224 |
| 2,534,504 | 12/1950 | Engstrom | 222/383.1 |
| 2,594,223 | 4/1952 | Santarelli | 299/97 |
| 3,869,071 | 3/1975 | Roberts | 222/385 |
| 5,125,545 | 6/1992 | Passalacqua | 222/383.1 |
| 5,335,853 | 8/1994 | Wirz | 239/142 |
| 5,624,059 | 4/1997 | Lo | 222/383.1 |

FOREIGN PATENT DOCUMENTS

| | | | |
|---|---|---|---|
| 26480 | 4/1932 | Netherlands | 285/35 |

*Primary Examiner*—Philippe Derakshani
*Attorney, Agent, or Firm*—Jaeckle Fleischmann & Mugel, LLP

[57] ABSTRACT

A pump unit is adapted for attachment to a liquid container having a liquid discharge opening bounded by an annular rim formed with an external screw thread by providing the housing of the pump unit with an annular mounting flange and employing a two-part cap rotatably coupled to the mounting flange to threadably couple the pump unit to the screw thread of the container rim. The parts of the cap are hinge connected to allow for swinging movement of the parts between remote and adjacent positions as an incident to which the cap is coupled to the mounting flange and provided with a latch for retaining the parts in their adjacent position.

17 Claims, 2 Drawing Sheets

FIG. 4
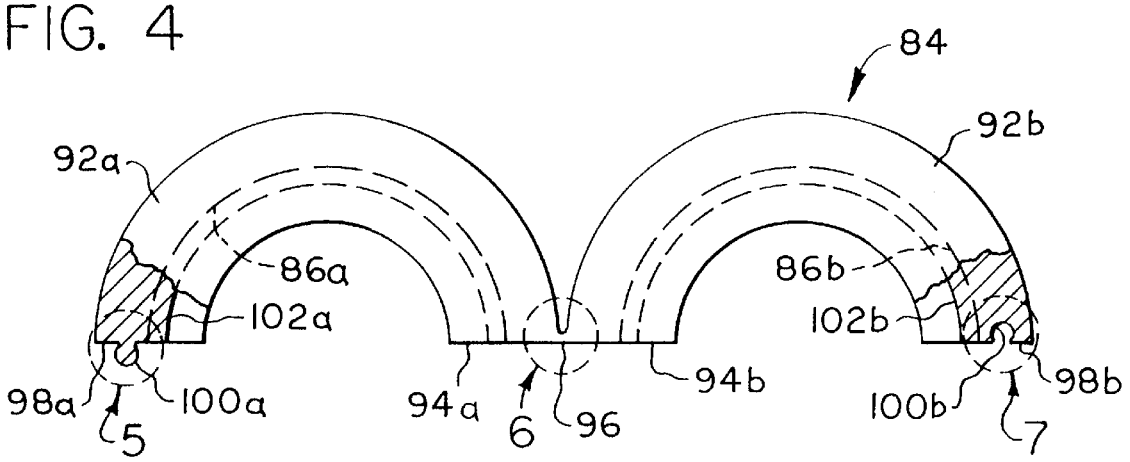
FIG. 5
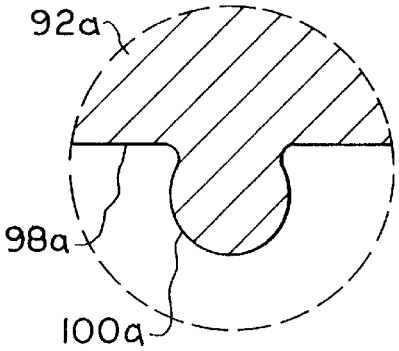
FIG. 6
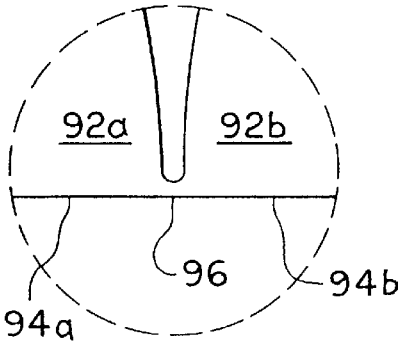
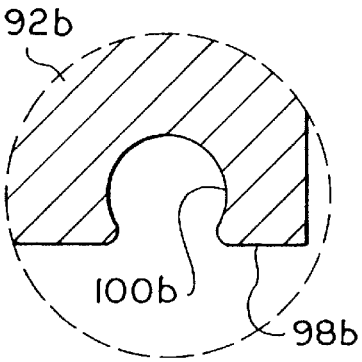
FIG. 7
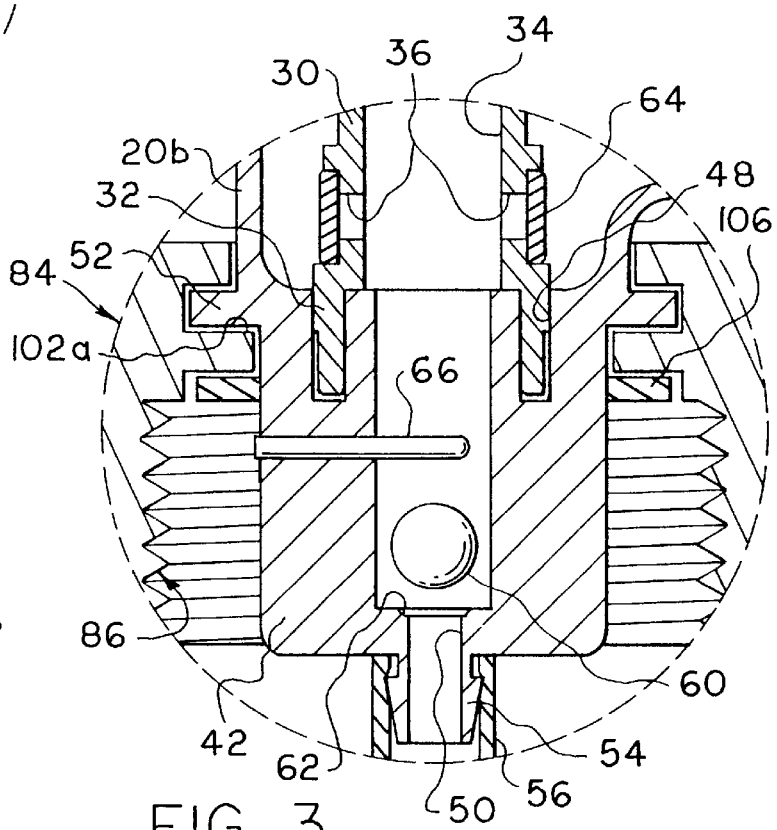
FIG. 3

PUMP UNIT

BACKGROUND OF THE INVENTION

It is known to provide a manually operable compressed air pump unit to dispense liquid from a container, wherein such unit includes a pump barrel slidably receiving a manually operable plunger controlling entry of liquid from the container into a pump chamber via a first valve and discharge of liquid from the pump chamber into a reservoir via a second valve for subsequent discharge from the reservoir via a tube fitted with a manually operable spray control valve, as evidenced for instance by U.S. Pat. Nos. 1,059,373; 1,986,756; and 2,281,142.

It is also known to removably attach manually operable pumps of various sorts to liquid containers by fitting these pumps with caps intended to threadably engage with external screw threads carried by mounting rims bounding discharge openings of the containers. A drawback of known pump unit constructions of this general type is that a different pump unit is required for differently sized containers having unique screw thread sizes/shapes.

SUMMARY OF THE INVENTION

The present invention is generally directed towards an improved pump unit for use in dispensing liquid from a container to which the unit is attached by a screw threaded cap, and more particularly to a pump unit where its principal parts may be fabricated as a common subassembly selectively attached to a series of liquid containers having mounting screw threads of differing size and/or thread design by selectively fitting the subassembly with a series of separately formed caps having mounting threads corresponding in size and/or thread design to those of the series of containers.

In a preferred form of the invention, the common subassembly of the pump unit includes a housing fitted with first mounting means conveniently in the form of an annular mounting rib, and the cap includes two parts having arculate recesses, which cooperate to define an annular recess for loosely receiving the mounting rib, such as will permit rotation of the cap relative to the housing when the cap parts are maintained adjacent one another. The cap parts are also formed with arculate thread portions, which cooperate, when the cap parts are maintained adjacent one another, to define a screw thread adapted for threaded engagement with the mounting screw threads of a given liquid container.

Preferably, the cap parts are connected together by a hinge for swinging movement between a remote position and an adjacent position in which the cap parts may be maintained by a latch.

Further, in accordance with the present invention, the pump unit is formed with a unique housing consisting of two housing parts which define or cooperate to define all elements of the pump subassembly except for its movable parts consisting of fluid flow control valves and a manually-operated pump plunger or piston.

BRIEF DESCRIPTION OF THE DRAWINGS

The nature and mode of operation of the present invention will now be more fully described in the following detailed description taken with the accompanying drawings wherein:

FIG. 3 is an enlarged view of the area of FIG. 2 designated as 3;

FIG. 4 is a top plan view of the attachment mounting cap shown in FIG. 2, partially broken away for clarity; and FIGS. 5, 6 and 7 are enlarged views of the areas of FIG. 4 designated as 5, 6 and 7, respectively.

DETAILED DESCRIPTION

Figure 1:
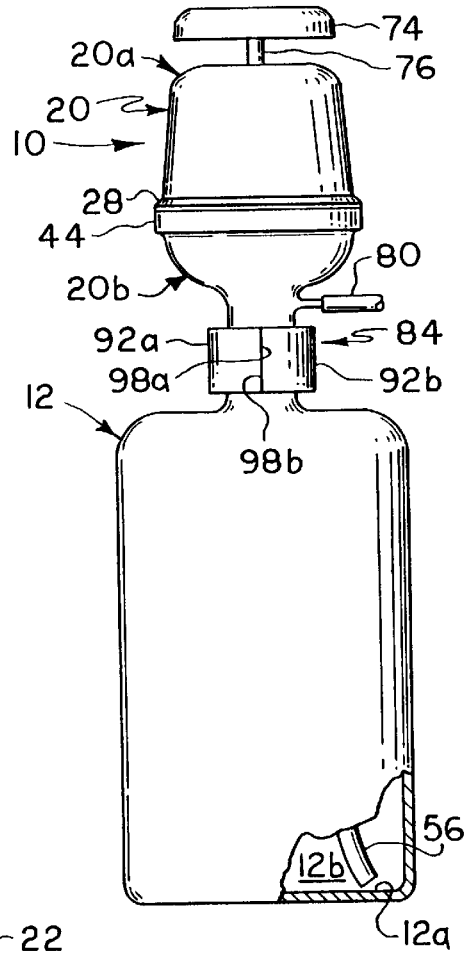
FIG. 1 is a side elevational view showing a combination pump and sprayer attachment of the present invention mounted on a liquid container.
Figure 2:
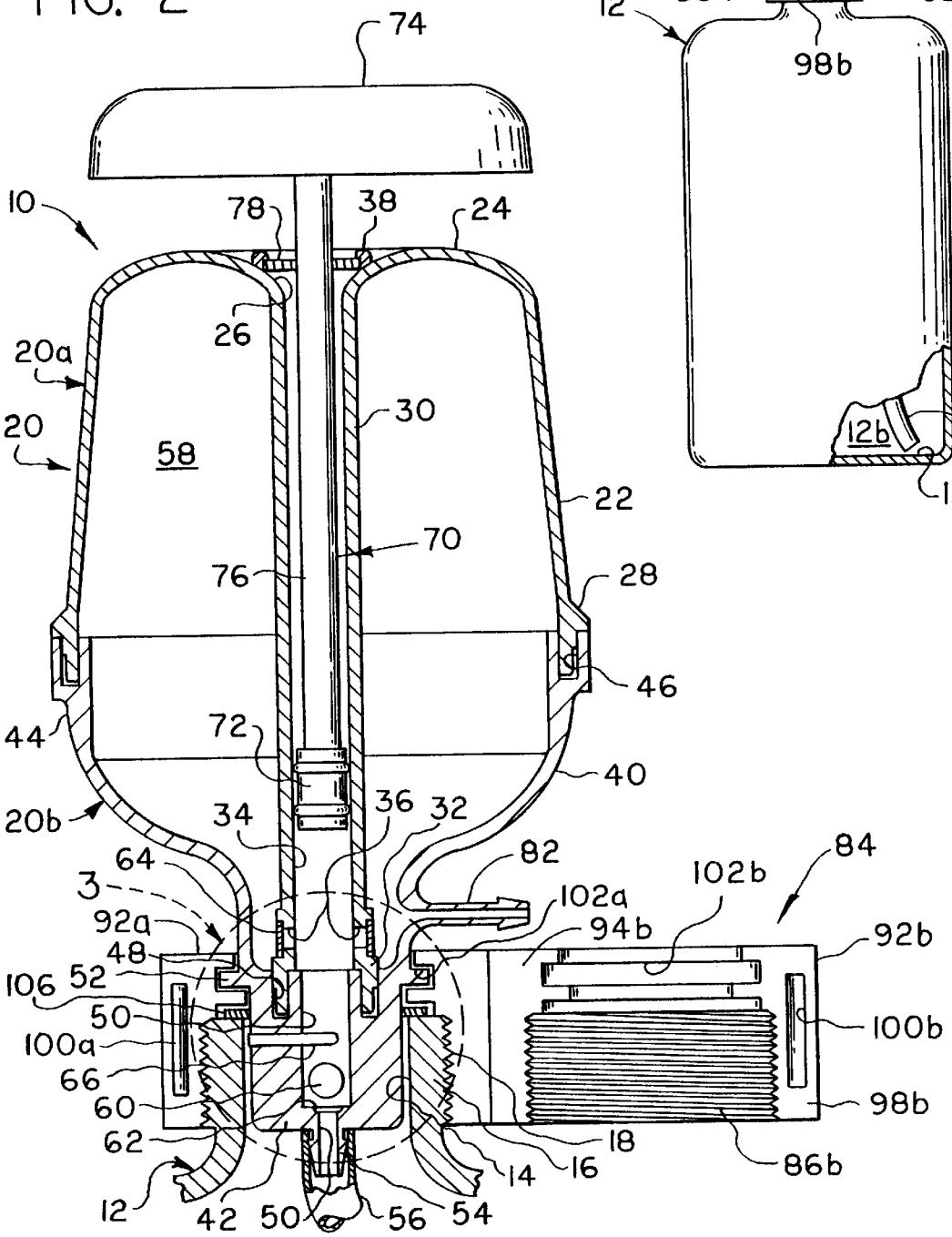
FIG. 2 is a vertical sectional view of the attachment.

Reference is first made to FIGS. 1 and 2, wherein a pump unit formed in accordance with the present invention is generally designated as 10 and shown as being adapted for use in dispensing liquid from a suitable container 12 having a liquid discharge opening 14 bounded by an annular mounting rim 16 formed with an external screw thread 18. The construction of container 12 may be conventional in all respects.

Pump unit 10 includes a pump housing 20 formed from first and second housing parts 20*a* and 20*b*, respectively. Housing part 20*a* is shown in FIG. 2 as including a first generally cup-shaped portion having an annular side wall 22 joined at one end to an end wall 24 having a centrally-located through opening 26 and defining at an opposite or free end a first annular mounting rim 28; and a cylindrical pump barrel 30 having one end joined to end wall 24 in alignment with opening 26 and defining at an opposite or free end a second annular mounting rim 32. Pump barrel 30 is shown as bounding a cylindrical pumping chamber 34 aligned with end wall opening 26 and as defining one or more radially through passageways 36 disposed adjacent mounting rim 32 for flow communication with pumping chamber 34. Preferably, end wall 24 is formed with an annular mounting rim 38 arranged concentrically of opening 26.

Housing part 20*b* is also shown in FIG. 2 as including a second generally cup-shaped portion having an annular side wall 40 joined at one end to a base portion 42 externally sized to be removably inserted into a container 12 through discharge opening 14 and defining at an opposite end a third annular mounting rim 44 having an annular mounting recess 46 sized and shaped for fluid sealing engagement with first annular mounting rim 28. Housing parts 20*a* and 20*b* may be considered as having first or adjacent connected ends defined by mounting rims 28 and 44, and second or remote ends defined by end wall 24 and base portion 42.

Base portion 42 additionally defines a fourth annular mounting means, such as a tubular recess 48 arranged to open through an upper surface of the base portion and being sized and shaped for fluid sealing engagement with second annular mounting rim 32, a fluid passageway 50 for placing pumping chamber 34 in flow communication with the interior of container 12, and a first mounting means preferably in the form of an annular, radially outwardly projecting rib 52. Passageway 50 terminates in a barbed coupling 54, which extends from a lower surface of base portion 42 and serves to mount an upper end of a tube 56 extending from base 42 to a point adjacent a bottom wall 12*a* of container 12 in order to insure essentially complete discharge of the contents from the interior 12*b* of such container.

As will be apparent from viewing FIG. 2, housing part 20*a* and housing part 20*b* arranged upwardly of base portion 42 cooperate to define an enlarged reservoir 58 disposed concentrically outwardly of pump barrel 30. Thus, housing part 20*a*, and also the upper part of housing part 20*b* in the construction shown in the drawings, are required to have a substantially larger diameter than base portion 42, such that they cannot fit within container opening 14. Preferably, the housing parts are each formed of molded plastic material, and permanently joined to one another by suitable means, such as by an adhesive.

Pumping chamber 34 is arranged for flow communication with the interior 12*b* of container 12 via passageway 50 under the control of a first one way valve including a ball 60 arranged to engage seat 62 and with reservoir 54 via passageways 36 under the control of a second one way valve including an annular, resiliently deformable ring or band 64. The extent of movement of ball 60 away from seat 62 is limited by a suitable abutment pin 66.

A manually operated plunger or piston 70 is slidably associated with pump barrel 30, and includes a piston head 72 slidably supported in fluid-sealed relationship within the pump barrel, a manually operated handle 74 arranged exteriorly of pump housing 20 and a piston rod 76 having its opposite ends connected to the piston head and the pump handle. Piston rod 76 may be guided during reciprocation thereof within pump barrel 30 by an apertured disc or guide ring 78 peripherally located by mounting rim 38. The described elements of plunger 70 may conveniently be formed from molded plastic materials.

An outlet or discharge tube 80 is connected to reservoir 58 by a barbed coupling 82 molded-formed integrally with one or the other of housing parts 20*a* or 20*b*. The discharge end, not shown, of tube 80 may be connected, as desired, to a known manually-controlled spray nozzle, also not shown.

The above-described construction forms a common subassembly, which may be selectively attached to a series of containers having mounting screw threads 18 of differing size and/or thread design or shape by providing the subassembly with a series of separately formed container caps or closures 84, which have mounting screw threads 86 corresponding in size and/or thread design or shape to screw threads 18 and a common means adapted for individually mounting the caps on subassembly rib 52.

One cap 84 is shown for example in FIGS. 2 and 4 as being formed with a first part 92*a* and a second part 92*b* having first or adjacent edges or surfaces 94*a* and 94*b* connected to one another by a hinge device 96 and second or remote edges or surfaces 98*a* and 98*b* adapted to be fixed in an adjacent relationship by a suitable latch defined as by a convex locking rib 100*a* sized for receipt within a concave locking slot 100*b*. Cap parts 92*a* and 92*b* are also formed with arculate mounting recess portions 102*a* and 102*b*, and arculate screw threaded portions 86*a* and 86*b*, as best shown in FIGS. 2 and 4. Preferably, cap 84 is of integrally formed, molded plastic construction, wherein locking rib 100*a* and locking slot 100*b* are sized and resiliently deformable sufficiently to permit the rib and slot to be snap-fitted together for purposes of cooperation with hinge device 96 to maintain cap parts 92*a* and 92*b* adjacent one another, as shown in FIG. 1.

Hinge device 96 serves to couple cap parts 92*a* and 92*b* for swinging movement between their relatively remote or open position shown in FIGS. 2 and 4 into their adjacently disposed position shown in FIG. 1. In this latter position, mounting recess portions 102*a* and 102*b* cooperate to define an annular recess, not shown, which is sized to loosely receive annular mounting flange 52, thereby to connect or couple cap 84 to housing 20 for free rotational movement about an axis, not shown, extending lengthwise of housing parts 20*a* and 20*b*. Also in this latter position, screw threaded portions 86*a* and 86*b* cooperate to define an internal screw thread 86 sized/shaped to threadably engage with screw thread 18 for purposes of removably mounting cap 84, and thus the whole of pump unit 10, on container 12 with housing first portion 20*b* inserted inwardly thereof through opening 14. Unit 10 may be fitted with a suitable resiliently deformable sealing ring 106 to facilitate fluid sealing of cap 84 relative to container mounting rim 16.

As will be apparent, once cap 84 is threadably coupled to container rim 16, a user may dispense liquid from container 12 by first manipulating handle 74 to extend plunger 70, i.e. move same outwardly relative to pump barrel 30 in a direction away from its inserted position shown in FIG. 2, in order to produce a partial vacuum within inner end of pumping chamber 34 which is sufficient to lift ball valve 60 from closing engagement with valve seat 62 and then draw liquid contents of the container upwardly into the pumping chamber. Thereafter, manipulation of handle 74 to purposes of returning plunger 70 to its initial position will first serve to return ball valve 60 to its closed or seated position and then force liquid previously drawn into pumping chamber 34 to flow into reservoir 58 past second valve 64, with the latter tending to return to its closed or seated position relative to outlet opening 36 upon arrival of the plunger in its initial position. Repeated strokes of plunger 70 will serve to charge or fill reservoir 58 to a point at which air trapper therein will be compressed sufficiently to expel liquid through conduit 80 upon opening of a suitable hand operated discharge flow control valve, not shown, associated with such conduit. The discharge control valve may be of the type with which commercially available, manually operably compressed air garden type sprayers are typically fitted.

As previously indicated, an advantage of the illustrated construction of pump unit 10 is that housing portions 20*a* and 20*b*, and plunger 70 may be assembled as a pump unit subassembly, which can be selectively employed to dispense liquid from a series of liquid containers having differently sized/shaped screw threads by the expedient of providing a series of caps 84 having appropriately sized/shaped internal screw threads and a common or like sized annular mounting recess for selectively mounting the caps one at a time on mounting flange 52. Fabrication of this series of caps is facilitated by employing a common or basic mold fitted with a series of removable inserts required to produce caps having desired size/shape thread configurations.

As shown in the drawings, base 42 of housing portion 20*b* is required to be transversely sized so that it may be freely inserted through the smallest diameter opening 14 of a series of liquid containers 12 with which pump unit 10 is intended to be employed. It will also be understood that the length of base 42, as measured between its lower end and mounting flange 52, is limited by the requirement that such lower end be spaced sufficiently from container bottom wall 12*a* so as to allow for flow of liquid inwardly of pump chamber 34 through tube 56, when cap 84 is fixed to mounting rim 16 of the shortest container of the series of containers with which the pump unit is intended to be employed.

What is claimed is:

1. A pump unit adapted for removable attachment to a liquid container for use in dispensing liquid therefrom, said container having a liquid discharge opening bounded by an annular mounting rim formed with an external screw thread, and said pump unit comprising:

a pump housing including a portion sized to be removably inserted into said container through said opening, said pump housing having a first mounting means associated with an outer surface thereof; and cap means having first and second parts moveable relative to one another into an adjacently disposed position wherein said parts cooperate to define a second mounting means engaging with said first mounting means for connecting said cap means to said housing and an internal screw thread engageable with said screw thread of said mounting rim for mounting said pump unit on said container with said portion inserter within said opening, and means for maintaining said parts adjacent one another.

2. A unit according to claim 1, wherein said parts each have first and second spaced edges, and said means to maintaining said parts adjacent one another includes hinge means for hingedly joining said first edges of said parts and latch means joining said second edges of said parts.

3. A unit according to claim 2, wherein said first mounting means is an annular flange, and said parts cooperate to define an annular recess for receiving said annular flange when said parts are maintained adjacent one another.

4. A unit according to claim 3, wherein said cap means is of one piece molded plastic construction.

5. A unit according to claim 2, wherein said first mounting means is an annular flange, and said parts cooperate to define an annular recess for loosely receiving said annular flange when said parts are maintained adjacent one another to permit rotation of said cap means relative to said pump housing.

6. A unit according to claim 1, wherein said pump housing has first and second housing parts cooperating to define an elongated pumping chamber radially outwardly bounded by a reservoir, one of said housing parts defining said housing portion and said first mounting means, said housing portion defining a first fluid passageway for connecting said pumping chamber with said container for withdrawing liquid therefrom, one of said housing parts defining a pump discharge connected into said reservoir, and said pump unit additionally includes a first one-way valve for permitting flow of fluid through said first fluid passageway into said pumping chamber, a second fluid passageway for connecting said pumping chamber to said reservoir, a second one-way valve for permitting flow of liquid from said pumping chamber into said reservoir and a manually operable pump piston slidably supported for movement within said pumping chamber for insequence withdrawing liquid from said container into said pumping chamber through said first passageway and expelling liquid from said pumping chamber into said reservoir through said second passageway.

7. A unit according to claim 1, wherein said pump housing includes first and second housing parts, said first housing part including a first cup-shaped portion having an annular side wall joined at one end to an end wall having a through opening and defining at an opposite end a first annular mounting rim and a pump barrel having one end joined to said end wall in alignment with said through opening and defining at an opposite end a second annular mounting rim, said pump barrel having a passageway extending radially therethrough adjacent said second annular mounting rim, said second housing portion including a second cup-shaped portion having an annular side wall joined at one end to a base portion defining said portion sized to be removably inserted into said container and defining at an opposite end a third annular mounting rim fluid sealably engaged with said first annular mounting rim, said base additionally defining a fourth annular mounting means fluid sealably engaged with said second annular mounting rim, a fluid passageway for placing said pump barrel in flow communication with said container and said first mounting means, said first and second housing parts cooperating to define a reservoir disposed in flow communication with said pump barrel by said passageway of said pump barrel, and one of said pump parts defines a pump discharge placed in flow communication with said reservoir.

8. A compressed air pump and sprayer unit adapted to be removably attached to a liquid container from which liquid is to be dispensed, said container having a liquid discharge opening-bounded by an annular mounting rim, said unit comprising:

a pump housing having a pair of housing parts formed with connected first ends and remote second ends, one of said housing parts having said second end thereof transversely sized for insertion inwardly of said container through said discharge opening and defining mounting means arranged between said first and second ends thereof, another of said housing parts being transversely sized to prevent insertion thereof inwardly through said discharge opening; and cap means engaging with said mounting means and with said mounting rim for mounting said housing on said container.

9. A unit according to claim 8, wherein said cap means includes first and second cap parts, and means for maintaining said cap parts in an adjacent relationship for mounting said cap means on said mounting means and on said mounting rim.

10. A unit according to claim 9, wherein said cap parts have first and second edges, and said means for maintaining said cap parts in an adjacent relationship includes hinge means for hingedly connecting said first edges and latch means for joining said second edges.

11. A unit according to claim 10, wherein said first and second cap parts cooperate when maintained in said adjacent relationship to define a screw thread adapted to removably engage with a screw thread defined by said mounting rim.

12. A unit according to claim 11, wherein said mounting means is an annular mounting flange and said first and second cap parts cooperate when maintained in said adjacent relationship to define an annular recess for receiving said annular mounting flange.

13. A unit according to claim 12, wherein said cap means is of integrally molded plastic construction.

14. A unit according to claim 13, wherein said annular recess is sized to loosely receive said annular mounting flange thereby to permit said cap means to rotate relative to said first portion about an axis extending lengthwise thereof through said first and second ends.

15. A pump unit adapted for removable attachment to a liquid container for use in dispensing liquid therefrom, said container being of the type having a liquid discharge opening bounded by an annular rim having an external screw thread, said unit comprising:

a pump housing including a portion sized to be inserted into said container through said opening and an annularly extending mounting flange; and a cap for removably mounting said pump housing on said container with said portion extending thereinto through said discharge opening, said cap including first and second parts having arculate mounting recess portions and arculate screw thread portions, hinge means for connecting said parts for swinging movement between a remote position and an adjacent position, and latch means operable to retain said parts in said adjacent position, wherein said recess portions cooperate to define annular recess means for loosely receiving said mounting flange to mount said cap for rotation relative to said pump housing and said screw thread portions cooperate to threadably engage with said external screw thread to removably mount said pump housing on said container.

16. A pump unit adapted for removable attachment to a liquid container for use in dispensing liquid therefrom, said container having a liquid discharge opening bounded by an annular mounting rim, and said pump unit comprising:

a pump housing including first and second housing parts, said first housing part including a first cup-shaped portion having an annular side wall joined at one end to an end wall having a through opening and defining at an opposite end a first annular mounting rim and a pump barrel having one end joined to said end wall in alignment with said through opening and defining at an opposite end a second annular mounting rim, said pump barrel having a passageway extending radially therethrough adjacent said second annular mounting rim, said second housing part including a second cup-shaped portion having an annular side wall joined at one end to a base portion and defining at an opposite end a third annular mounting rim fluid sealably engaged with said first annular mounting rim, said base portion additionally defining a fourth annular mounting means fluid sealably engaged with said second annular mounting rim, a fluid passageway for placing said pump barrel in flow communication with said container and including one way valve means for limiting flow therethrough from said container to said pump barrel, said first and second housing parts cooperating to define a reservoir disposed in flow communication with said pump barrel by said passageway of said pump barrel, said passageway of said pump barrel including one way valve means for limiting flow therethrough from said pump barrel to said reservoir, and one of said pump parts defines a pump discharge placed in flow communication with said reservoir;

a manually operated pump piston slidably supported within said pump barrel; and means for removably attaching said base portion to said container.

17. A pump unit adapted for removable attachment to a liquid container for use in dispensing liquid therefrom, said container having a liquid discharge opening bounded by an annular mounting rim, said pump unit comprising:

a pump barrel having opposite ends, a side wall disposed outwardly of said barrel and joined to said opposite ends to cooperate with said barrel to define a reservoir, said pump barrel having a first passageway extending radially through one of said ends for placing said barrel adjacent said one of said ends in flow communication with said reservoir, a one way valve for limiting flow through said first passageway from said barrel adjacent said one end to said reservoir, a second passageway for placing said barrel adjacent said one end in flow communication with said container, a one way valve for limiting flow through said second passageway from said container to said barrel adjacent said one end, a manually operable pump piston extending into said pump barrel through another of said ends of said pump barrel, liquid discharge connected into said reservoir, and means for removably mounting said pump unit on said container mounting rim with said second passageway placed in flow communication with the interior of said container.

* * * * *